United States Patent [19]

Dedman et al.

[11] 3,930,457

[45] Jan. 6, 1976

[54] CONDUIT-MOUNTED VALVE-VENT INTERLOCK ESPECIALLY FOR TANK SHIPS

[75] Inventors: Wendell W. Dedman, Darien, Conn.; Heinz F. Weyer, Waseenaar Zh, Netherlands; Duncan D. Wimperis, Tarrytown, N.Y.

[73] Assignee: Texaco Inc., New York, N.Y.

[22] Filed: Sept. 23, 1974

[21] Appl. No.: 508,309

[52] U.S. Cl. ..... 114/74 R; 114/212; 137/608

[51] Int. Cl.[2] ..... B63B 25/08; B63J 2/08

[58] Field of Search ..... 114/74, 211, 212; 137/587, 137/608

[56] References Cited

UNITED STATES PATENTS 1,099,127 6/1914 Hay ..... 114/212

2,049,987 8/1936 Willenborg ..... 114/74 R X

*Primary Examiner*—Trygve M. Blix
*Assistant Examiner*—Sherman D. Basinger
*Attorney, Agent, or Firm*—T. H. Whaley; C. G. Ries; Henry C. Dearborn

[57] ABSTRACT

A conduit vent-and-valve combination especially adapted for tank ships employing gas-inerting of cargo tanks. It includes location of the vent and valve adjacent to one another in the conduit, and employs mechanical interlock between the valve hatch cover and an extension of the valve stem in order to prevent closing the hatch unless the valve is fully open.

12 Claims, 4 Drawing Figures

CONDUIT-MOUNTED VALVE-VENT INTERLOCK ESPECIALLY FOR TANK SHIPS

BACKGROUND OF THE INVENTION

1. Field of the Invention

This invention concerns tank-ship construction in general, and more particularly relates to certain elements of the structure employed for supplying an inert gas to a plurality of tanks in a tank ship. Specifically, it concerns the combination of a valve located in a conduit for supplying the inert gas, along with a vent hatch located in the same conduit adjacent to the valve.

2. Description of the Prior Art

In tank ships that are designed for carrying petroleum products, it has been found (particularly in the large-sized tankers now generally being constructed) that the danger of explosive atmospheres developing in empty or partially empty cargo tanks becomes extremely great. In order to overcome this situation, one of the most universally acceptable procedures is that of introducing an inert gas to the empty tank space involved. Such introduction of inert gas involves the use of a main conduit for supplying the inert gas, along with branch conduits to individual tanks. Heretofore, such systems have relied upon the use of so-called pressurevacuum valves for avoiding excess over- or underpressure in the tanks. However, these pressures involved are quite low, and the use of such breather valves entails expensive mounting. Also, because such low pressure safety-valve instruments are relatively delicate, they are more subject to fouling, and consequently the safety factor might be lost.

Consequently, it is an object of this invention to provide a simple yet effective combination that is particularly applicable to petroleum tank ship structures.

SUMMARY OF THE INVENTION

Briefly, this invention concerns a combination that applies to the combination with a tank ship that has a common conduit for supplying an inert gas to a plurality of tanks. Each of the said tanks has a branch conduit from said common conduit, and each of said branch conduits has valve means for isolating that tank from said common conduit. The combination of this invention also comprises a hatch on said branch conduit located between the tank and said valve means, and interlock means cooperating with said valve means and said hatch for maintaining said hatch open unless said valve means is fully opened.

Again, briefly, the invention relates to apparatus that is in combination with a tank ship having a common conduit for supplying an inert gas to a plurality of cargo tanks. Each of the said tanks has a branch conduit from said common conduit, and each of said branch conduits has a butterfly valve mounted therein for isolating that tank from said common conduit. The said butterfly valve has an operating shaft extending outside of said branch conduit. The apparatus combination comprises a hatch on said branch conduit located between said tank and said butterfly valve for venting said tank to prevent excess pressure therein, and a cover for said hatch having a hinge at the edge away from said butterfly valve. It also comprises an arm extending radially from said cover and fixed rigidly thereto for hinging movement therewith, and a solid disc fixedly attached to said operating shaft and having a peripherally located notch sized to fit said arm therein. It also comprises the relative location of said hatch and said valve, and the dimensions of said arm being such that said cover cannot be closed unless said arm is in said notch, and the said notch is substantially located in the plane of the closure member of said valve.

Again briefly, the invention concerns apparatus in combination including a tank ship having a plurality of cargo tanks and a common conduit for supplying an inert gas to said tanks. It also comprises a plurality of branch conduits for connecting said common conduit to said tanks, and each of said branch conduits has a hatch with a hinged cover for venting the tank when said cover is open. It also comprises valve means adjacent to said hatch, and means for interlocking said hinge cover and said valve means for preventing said cover from being closed unless said valve means is fully open.

Again briefly, the invention concerns in combination a tank ship that has a plurality of cargo tanks and a common conduit for supplying an inert gas to said tanks. It also comprises a plurality of branch conduits for connecting said common conduit to said tanks, each of said branch conduits having a hatch with a hinged cover for venting the tank when the cover is open. The said hinge is located on the side towards said tank. A butterfly valve is adjacent to said hatch and located in said branch conduit on the side of said hatch toward said common conduit. The said valve has a valve disc mounted on a diametrically disposed shaft, and said shaft extends outside of said branch conduit. A solid disc is fixed to said shaft near the end that extends outside of the conduit. and a radial notch is peripherally located in said solid disc and substantially in the plane of said valve disc. There is an integrally attached arm extending radially from said hinged cover on the other side from said hinge, and it is sized to fit into said notch. The said arm and said solid disc have relative dimensions such that said arm will contact the disc and prevent the hatch cover from being closed unless said notch is aligned with the arm.

Again briefly, the invention is in a combination with a conduit that has valve means therein. It concerns a vent hatch in said conduit located adjacent to said valve means, and it also concerns interlock means for preventing closure of said hatch unless said valve means is fully open.

Once more briefly, the invention is in a combination with a conduit having a butterfly valve mounted therein and a vent hatch located downstream and adjacent to said valve. The said valve has a stem extending outside of said conduit for actuating the valve, and said stem has a solid disc mounted on the end thereof for rotation therewith. The said vent hatch has a cover mounted with a hinge on the side of the hatch away from said valve. There is an integrally attached arm on said cover extending into overlapping relation with said solid disc in order to prevent closing of the cover unless said valve stem is rotated into an open position of the valve. It also comprises a notch in said solid disc for receiving said arm when said valve is in said open position.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENTS

Some of the more comprehensive aspects of the invention relate to a combination as it applies to tankship structures, and particularly those carrying petroleum product cargos. The construction of such tank ships is such that the maximum amount of pressure (either positive or negative) that the cargo tanks can withstand is quite limited, e.g., about 8 pounds per square inch. Consequently, it is imperative that some kind of pressure relief or safety arrangement be provided in order to avoid costly spills of cargo.

Figure 2:
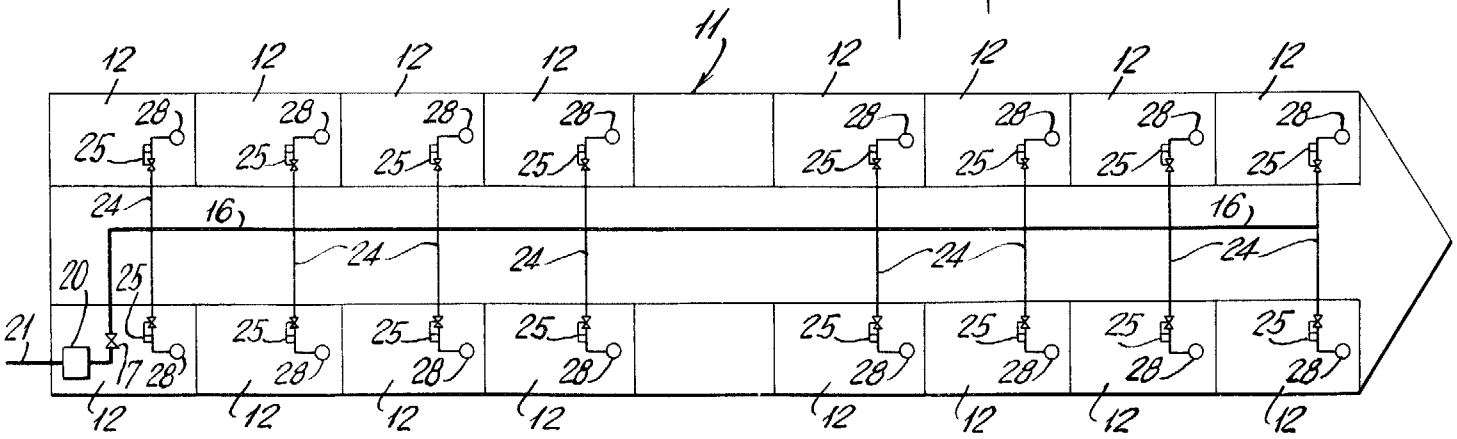
FIG. 2 is a schematic that indicates a plan view, showing a tank ship with cargo tanks and gas-inerting conduits.

FIG. 2 is a schematic showing of a tank ship 11 that has a plurality of cargo tanks 12. It will be appreciated that these tanks may be arranged in different ways that include a large number of tanks located on both sides of the hull of the ship, as well as some central tanks (not shown) along the center line, if desired. It will also be understood that the FIG. 2 schematic indicates the forward portion of the tank ship 11, and the engine room (not shown) plus other structure may be located further aft.

In order to apply an inert gas to the various cargo tanks of the ship 11 as they are emptied or partially emptied, in accordance with the above indications, there is provided a main (common) inert-gas conduit 16. A valve 17 is located near the supply end of the conduit 16, and there is a deck seal unit 20. Such a seal unit for the inert gas is necessary, because the inert gas is supplied from the engine room. It is combustion products from the engine room that are supplied via a pipe 21 to be delivered from the engine room to the conduit 16 via the deck seal 20 and the valve 17.

The common, or main conduit 16 has branching conduits 24 that are connected thereto. These branch conduits 24 go to each of the plural cargo tanks 12. Incorporated into each of the branch conduits 24, there is a combined valve-and-vent hatch 25, which combination may take various forms such as those illustrated in FIGS. 1, 3, and 4.

It will be appreciated from the foregoing indications that as each of the cargo tanks becomes empty or is partially emptied, the current safety procedures involve introduction of an inert gas to fill the space above the cargo in the tank. This is carried out with the inert gas being supplied at a safe pressure, e.g., 3 pounds per square inch.

Each of the tanks 12 has the indicated branch conduit 24 that leads from the main, or common conduit 16 to an inlet 28 for each. In order to have individual control of the inert-gas application to the tanks 12, there is in each of the branched conduits 24 one of the above-indicated valve-vent hatch combinations 25. Such combined structures might take various forms, as already indicated. However, the preferred arrangement is like that illustrated in FIG. 1.

Figure 1:
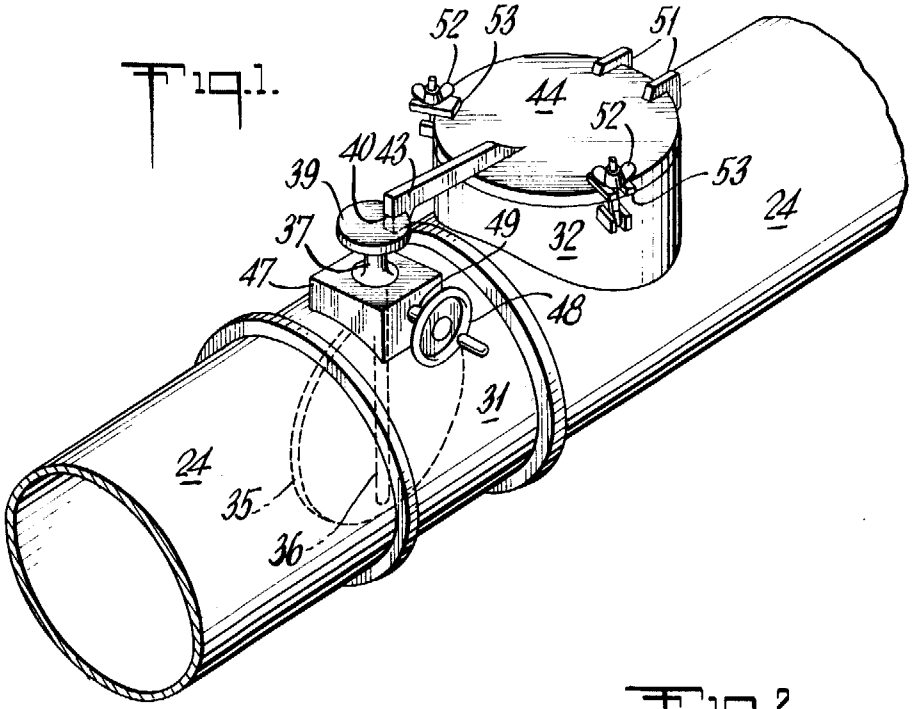
FIG. 1 is a view in perspective, showing a preferred combination of valve and vent-hatch in a conduit.

FIG. 1 illustrates a valve 31 and a vent hatch 32 located downstream in the conduit 24 and adjacent to the valve 31. It will be appreciated that the valve 31 is schematically indicated, and it is a butterfly valve having a valve disc 35 mounted on a diametrically disposed shaft, or stem 36. The shaft 36 extends outside of the conduit 24 and has fixed to its outer end 37 a solid disc 39. The disc 39 rotates with the shaft 36 (and end 37) at all times, and there is a notch 40 in the edge of the disc 39. The center of the notch 40 is located in the plane of the valve disc 35. This notch 40 is sized to fit the end of an arm 43 that is integrally attached onto the body of a cover 44 for the vent hatch 32.

It may be noted that the valve 31 has conventional gears (not shown) that are located in a gear box 47. They are driven by an ordinary hand wheel 48 that is on a shaft 49 which extends out from the gear box 47.

It may be noted that in FIG. 1 the parts are illustrated in the positions such that the valve 31 is held locked fully opened. This is because of the presence of the arm 43 in the notch 40 of the disc 39, the disc 39 being attached to the end of the stem, or shaft 36 of the valve.

The hatch cover 44 has a hinge which includes a pair of hinge brackets 51 that are located on the other side of the hatch from the valve 31. Consequently, when the cover 44 is opened by being pivoted about the hinge (not shown) that supports the brackets 51, it will raise the arm 43 upward out of the notch 40 in the disc 39. When the hatch cover 44 is closed it may be held tightly shut by means of conventional hold-down fixtures, e.g., a plurality of pivoted bolt and wing nuts 52 that cooperate with U-shaped wings 53 which are located at several places around the periphery of the cover 44. I It will be appreciated that when the gas-inerting process is underway, the valve 31 will be fully open and the hatch 32 will be shut so that the inert gas may flow into and fill the particular tank 12. This is accomplished with the inert gas at relatively low pressure, as indicated above, for example, about 3 pounds per square inch. However, since the structure of tank ships is such that each tank is only designed to withstand about 8 pounds per square inch, maximum pressure, it is important that no high pressure (either positive or negative) be applied to any tank either during cargo-filling or emptying procedure, or the like. Consequently, when a given cargo tank is to be isolated from the gas-inerting system, it is important that the vent hatch 32 not be closed when the valve 31 is closed also.

It will be understood that the danger of excessive pressure in a tank 12 exists whenever the valve 31 associated with that tank is closed. But such danger is avoided by the interlocking arrangement illustrated which makes sure that the valve 31 is fully opened whenever the hatch cover 44 is closed. Under all other positions of the valve 31, the hatch which must have been opened, will have its arm 43 extending in an overlapping manner relative to the solid disc 39 so that the hatch cover 44 cannot be closed. It will be appreciated that this insures that there is a vent opening for the tank 12 at the hatch 32 under all conditions, except when it is desired to introduce the inerting gas, and the latter is accomplished with the valve 31 fully opened.

Figure 3:
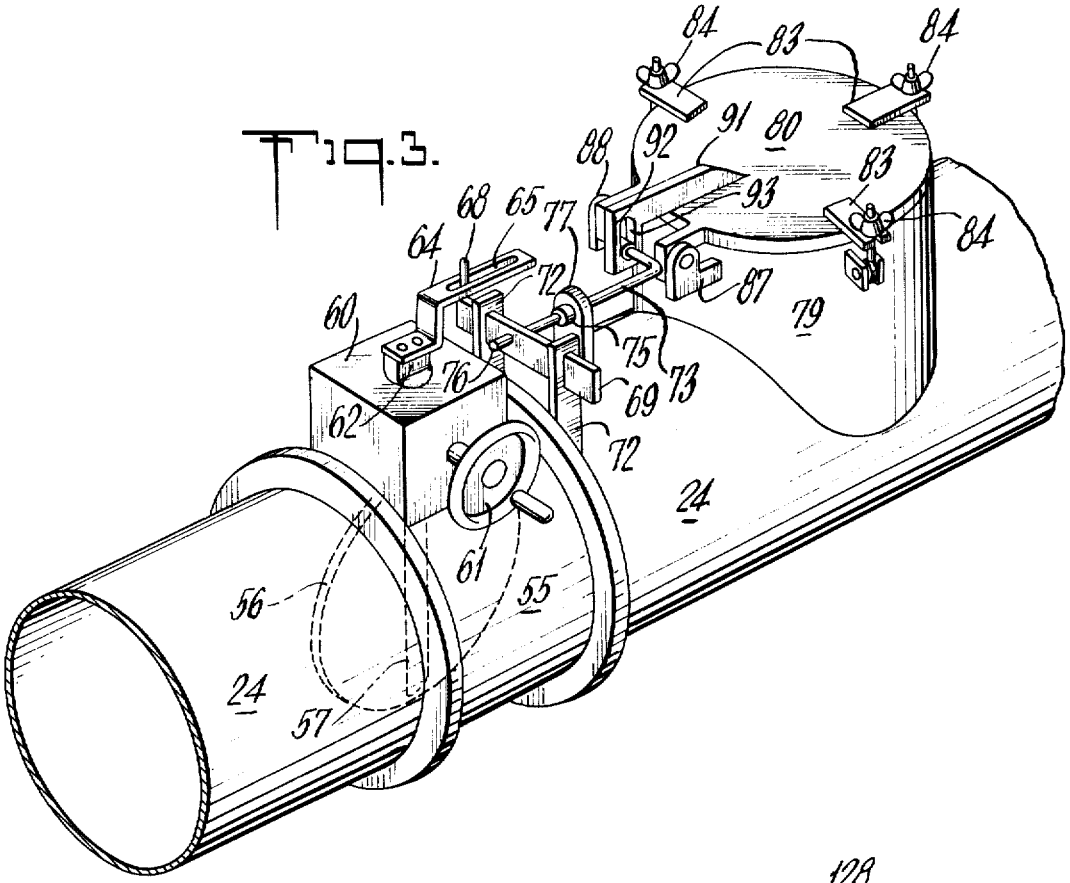
FIG. 3 is a view in perspective, showing another modification of a valve-and-vent-hatch combination.
Figure 4:
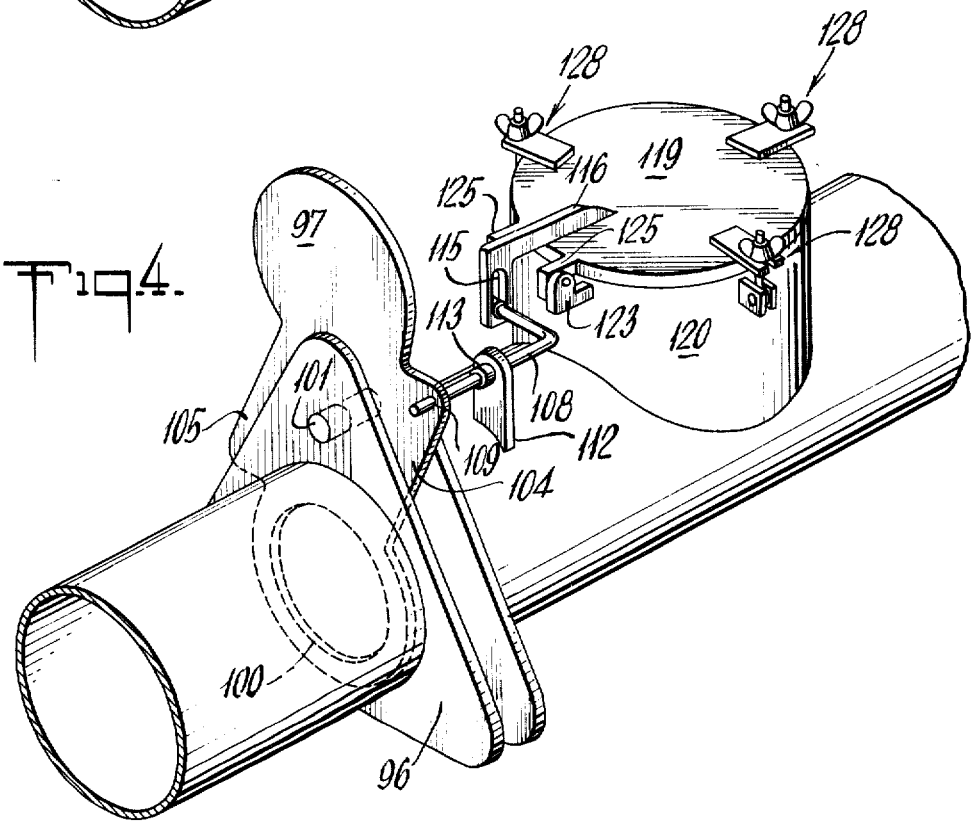
FIG. 4 is still another perspective, showing a third modification of a valve-and-vent-hatch combination.

FIGS. 3 and 4 illustrate two other modifications of combined structures for the valve-and-vent hatch combination. In FIG. 3, there is shown a butterfly-type valve 55 that has a valve disc 56 that is mounted on a shaft, or stem 57. The shaft 57 is rotated for controlling the opening and closing of the valve, by means of gearing (not shown) in a gear box 60. Such gearing is driven by a hand wheel 61.

An end 62 of the shaft 57 has a radially extending bracket 64 riveted thereon. Consequently, the shaft 57 may be rotated positively by the bracket 64 at all times.

There is a slot 65 in the bracket 64 that receives a short vertical cylindrical rod 68 which is attached to a transverse bar 69. The bar 69 is slidably supported with respect to the conduit 24, in a pair of vertical brackets 72. However, there is a hole 76 in the bar 69 which hole receives a rod 73 that is supported by a sleeve 75 secured in a bracket 77.

The rod 73 is slidable longitudinally in the sleeve 75 for disengaging the bar 69 by withdrawal from the hole 76.

It will be appreciated that movement of the valve disc 56 by means of its shaft 57 will rotate the bracket 64, along with the end 62 of the shaft 57. Consequently, by means of the rod 68, it will slide the bar 69 along in its support 72 unless the presence of the rod 73 in the hole 76 prevents such movement.

In this modification, there is a hatch 79 that has a hatch cover 80 with a plurality of conventional hold-down brackets 83 having U-shaped openings at the ends thereof for receiving conventional pivoted bolt-and-wing nut combinations 84. The cover 80 is hinged at a pair of hinge brackets 87 and 88, and there is attached to the cover 80 an arm 91 that extends radially out from the cover 80. At the outer end of the arm 91, there is a downward-extending portion 92 that has a vertical slot 93 therein. This slot 93 accommodates a roller on the other end of the bar 73 which bends at right angles to the part supported by the sleeve 75, in the manner illustrated. It will be understood that the arrangement permits closing of the hatch cover 80 only when the bar 73 is in the illustrated position so that it extends through the hole 76 in the transverse bar 69. At all other times, i.e., whenever the valve 55 is not fully open, the bar 73 will hold the hatch cover 80 open because it will be prevented from sliding toward the valve 55 by the flat bar 69.

Another modification is illustrated in FIG. 4. and in this case the particular type of valve is one that is descriptively known as a "line blind." Thus, a valve 96 is constructed in a conventional manner for that type. It includes a blank flange 97 that is situated opposite an open flange 100. These two flanges pivot about a central point, or shaft 101, so that when the valve is closed, the blank flange 97 will be rotated into the position occupied by the open flange 100 in the illustration. However, it will be noted that these two flanges are constructed with a pair of extending wing portions 104 and 105 which are designed to extend radially from the pivot 101 far enough to overlap the axis of a rod 108. In the wing 104, there is a hole 109 through which the end of the rod 108 may pass when the valve is in its open position, as illustrated in FIG. 4.

There is a bracket 112 with a sleeve 113 for supporting the rod 108 in such a manner as to permit sliding and rotating movement of the rod 108. There is a right-angle bend at the other end thereof, and there is a roller, as illustrated, which engages a slot 115 that is located in a downward-extending portion of an arm 116. The arm 116 is integrally attached to a hatch cover 119 of a vent hatch 120. The cover 119 is hinged as illustrated, and this includes brackets 123, shown, which have hinge pins as indicated that pass through wing lugs 125 which extend from the edge of the hatch cover 119. As before, it will be appreciated that there are conventional fasten-down fixtures 128 at a number of locations around the periphery of cover 119.

The action of the FIG. 4 structure is such that when the valve cover 119 is hinged open, it will withdraw the rod 108 from the hole 109 in the wing 104 of the valve flanges 97 and 100. Thereafter, the valve 96 may be shifted from its open to its closed position; but when closed, the hatch cover 119 will be held open because the rod 108 cannot then slide far enough to allow it to close since there is no hole in the wing 105.

While particular embodiments of the invention have been shown and described in considerable detail in accordance with the applicable statutes, this is not to be taken as in any way limiting the invention but merely as being descriptive thereof.

What is claimed is:

1. In combination with a tank ship having a common conduit for supplying an inert gas to a plurality of tanks, each of said tanks having a branch conduit from said common conduit, and each of said branch conduits having valve means for isolating that tank from said common conduit, the combination comprising a hatch on said branch conduit located between the tank and said valve means, and interlock means cooperating with said valve means and said hatch for maintaining said hatch open unless said valve means is fully open.

2. In combination with a tank ship in accordance with claim 1, the combination further comprising a hinged cover on said hatch, and said interlock means including means integrally attached to said hinged cover.

3. In combination with a tank ship in accordance with claim 2, wherein said means integrally attached to said hinged cover comprises an arm extending radially from said hinged cover.

4. In combination with a tank ship in accordance with claim 3, wherein said interlock means also comprises means actuated by said valve means for cooperating with said arm to maintain said hatch open unless said valve means is fully open.

5. In combination with a tank ship in accordance with claim 4, wherein said valve means is a butterfly type having a shaft and said valve-actuated means comprises radial means fixed on an extension of said shaft.

6. In combination with a tank ship in accordance with claim 5, wherein said radial means comprises a solid disc having a notch for receiving said arm.

7. In combination with a tank ship having a common conduit for supplying an inert gas to a plurality of cargo tanks, each of said tanks having a branch conduit from said common conduit, and each of said branch conduits having a butterfly valve mounted therein for isolating that tank from said common conduit, said butterfly valve having a closure member actuated by an operating shaft extending outside of said branch conduit, the combination comprising a hatch on said branch conduit located between said tank and said butterfly valve for venting said tank to prevent excess pressure therein, a cover for said hatch having a hinge at the edge away from said butterfly valve, an arm extending radially from said cover and fixed rigidly thereto for hinging movement therewith, a solid disc fixedly attached to said operating shaft and having a peripherally located notch sized to fit said arm therein, the relative locations of said hatch and said valve, and the dimensions of said arm being such that said cover cannot be closed unless said arm is in said notch, said notch being substantially located in the plane of the closure member of said valve.

8. In combination, a tank ship having a plurality of cargo tanks and a common conduit for supplying an inert gas to said tanks, a plurality of branch conduits for connecting said common conduit to said tanks, each of said branch conduits having a hatch with a hinged cover for venting the tank when said cover is open, valve means adjacent to said hatch, and means for interlocking said hinged cover and said valve means for preventing said cover from being closed unless said valve means is fully open.

9. In a combination according to claim 8, wherein said valve means is located between said hatch and said common conduit, and said interlocking means comprises an integrally attached arm extending radially from said hinged hatch cover.

10. In a combination according to claim 9, wherein said valve means comprises a butterfly-type valve including a valve disc with diametrically disposed shaft extending radially outside of said branch conduit, and means fixed to said valve shaft outside of said branch conduit for rotation with said valve disc, and said interlocking means further comprises means associated with said arm and said fixed means for preventing said cover from being closed unless said valve disc is in the fully open position.

11. In a combination according to claim 10, wherein said fixed means comprises a solid disc, and said associated means comprises a radial notch in said disc, said arm engaging said notch when said valve disc is fully open to permit said hatch to be closed but contacting said solid disc when said valve disc is not fully open to prevent closing said hatch.

12. In combination, a tank ship having a plurality of cargo tanks and a common conduit for supplying an inert gas to said tanks, a plurality of branch conduits for connecting said common conduit to said tanks, each of said branch conduits having a hatch with a hinged cover for venting the tank when the cover is open, said hinge being located on the side toward said tank, a butterfly valve adjacent to said hatch and located in said branch conduit on the side of said hatch toward said common conduit, said valve having a valve disc mounted on a diametrically disposed shaft, said shaft extending outside of said branch conduit, a solid disc fixed to said shaft near the end that extends outside of the conduit, a radial notch peripherally located in said solid disc and substantially in the plane of said valve disc, an integrally attached arm extending radially from said hinged cover on the other side from said hinge and being sized to fit into said notch, said arm and said solid disc having relative dimensions such that said arm will contact the disc and prevent the hatch cover from being closed unless said notch is aligned with the arm.

* * * * *